US006151777A

United States Patent [19]

Sakuraba

[11] Patent Number: 6,151,777

[45] Date of Patent: Nov. 28, 2000

[54] METHOD OF MANUFACTURING A BLANK RAW MATERIAL FOR A HOSE END FITTING

[75] Inventor: Kichiji Sakuraba, Ibaragi-ken, Japan

[73] Assignee: Okawa Screw Manufacturing Co., Ltd., Tokyo, Japan

[21] Appl. No.: 09/172,688

[22] Filed: Oct. 14, 1998

[30] Foreign Application Priority Data

Oct. 14, 1997 [JP] Japan ..... 9-280939

[51] Int. Cl.[7] ..... B21K 1/16

[52] U.S. Cl. ..... 29/890.144; 29/890.14; 29/557; 72/356

[58] Field of Search ..... 29/890.141, 890.14, 29/890.144, 557; 72/334, 358, 359, 356

[56] References Cited

U.S. PATENT DOCUMENTS

| | | | |
|---|---|---|---|
| 4,300,381 | 11/1981 | Sugiuchi et al. | 72/334 |
| 4,352,283 | 10/1982 | Bailey | 72/356 |
| 4,580,431 | 4/1986 | Oku et al. | 72/334 |
| 4,918,969 | 4/1990 | Takeuchi et al. | 72/334 |
| 4,932,251 | 6/1990 | Okada et al. | 72/334 |
| 5,088,311 | 2/1992 | Inoue | 72/356 |
| 5,119,663 | 6/1992 | Bottger | 72/356 |
| 5,129,251 | 7/1992 | Takikawa | 72/334 |
| 5,321,968 | 6/1994 | Poole et al. | 72/356 |
| 5,582,057 | 12/1996 | Litscher | 72/356 |

FOREIGN PATENT DOCUMENTS

| | | |
|---|---|---|
| 9-303645 | 11/1997 | Japan . |
| 9-303646 | 11/1997 | Japan . |
| 9-303649 | 11/1997 | Japan . |
| 10-9468 | 1/1998 | Japan . |

*Primary Examiner*—Irene Cuda
*Assistant Examiner*—Trinh Nguyen
*Attorney, Agent, or Firm*—Knobbe, Martens, Olson & Bear, LLP

[57] ABSTRACT

A method of manufacturing a blank raw material for a hose end fitting includes several steps, The method includes providing a rod-shaped material having a socket end and a screw-connecting end, and forming at the socket end of the rod-shaped material a pipe-shaped socket portion and a rod-shaped nipple portion surrounded by the pipe-shaped socket portion. A flange portion is formed having a diameter larger than that of the socket portion in an intermediate portion of the rod-shaped material by fitting a second pipe-shaped mold to the screw-connecting end so as to sandwich and compress the intermediate portion between the first pipe-shaped mold and the second pipe-shaped molds A screw-connecting portion is formed at the screw-connecting end by inserting a punch in a center portion of the rod-shaped material when an external periphery of the rod-shaped material is supported by the second pipe-shaped mold. A rod-shaped nipple having a through-hole extending to a bottom surface of the screw-connecting portion is formed by fitting a pipe-shaped punch between the pipe-shaped socket portion and the rod-shaped nipple portion.

10 Claims, 10 Drawing Sheets

METHOD OF MANUFACTURING A BLANK RAW MATERIAL FOR A HOSE END FITTING

BACKGROUND OF THE INVENTION

1. Field of the Invention

The present invention relates to a method of manufacturing a blank raw material for a hose end fitting and a method of manufacturing a hose end fitting. More particularly, the present invention relates to a method of manufacturing a hose end fitting in which a hose end fitting used for a hydraulic braking device of an automobile is manufactured and a method of manufacturing a blank raw material for a hose end fitting in which a blank raw material for a hose end fitting for manufacturing this hose end fitting is manufactured.

2. Description of the Related Art

A conventional hose end fitting for a hydraulic braking device of an automobile is manufactured in accordance with the procedure shown in FIGS. 1A through 1D. First, a main body 16 is manufactured through cutting or cold forming (deformation processing) (FIG. 1A). The main body 16 is formed from a raw material and comprises a cylindrical hose press-contacting portion 10 having a bottom, a cylindrical screw connecting portion 12 having a bottom, and a flange portion 14. Next, a thread is tapped in the inner circumference of the screw connecting portion 12 using a tap to form a female screw 18 and a through-hole 22 is punched in the center of a partitioning wall 20 (FIG. 1B).

On the other hand, a nipple 24, which serves as an inner cylinder and includes a seat portion 26 connected to a flared tube, is manufactured separately from the main body 16. Then, the nipple 24 is inserted through the through-hole 22 of the main body 16 such that the nipple 24 and the through-hole 22 are assembled. The nipple 24 and the main body 16 are adhered through brazing or welding. A hose end fitting is thereby manufactured (FIGS. 1C and 1D).

FIGS. 2A through 2D show another procedure of manufacturing a conventional hose end fitting for a hydraulic braking device of an automobile. In this manufacturing procedure, a seat portion 26 and a nipple attachment hole 28 are formed at a main body 16 through cold forming, and thereafter a thread is tapped in the inner circumference of a screw connecting portion 12 to form a female screw 18 (FIGS. 2A and 2B).

In contrast, a nipple 24 in which a flange 30 is formed at the distal end is manufactured separately from the main body 16. The flange 30 of the nipple 24 is inserted through the attachment hole 28 of the main body 16 such that the nipple 24 and the main body 16 are assembled and adhered (FIGS. 2C and 2D).

When the seat portion 26 is cold forming, since the bottom of the cylindrical screw connecting portion 12 is flattened in the previous process, it is difficult to manufacture the seat portion 26. Accordingly, the raw material is annealed in a partially manufactured state so as to be completely manufactured.

However, in the conventional methods of manufacturing a hose end fitting, the nipple and the main body are assembled after being separately manufactured and are subjected to air tightness inspection in order to guarantee there is no leakage of the assembled product. Therefore, a drawback arises in that a large number of man-hours is required. Moreover, there is a drawback in that the process for manufacturing the raw material is interrupted due to the annealing process and continuous production cannot be carried out.

Because the above-described hose press-contacting portion 10 is caulked after the hose is inserted thereinto, it is required that the hardness of the hose press-contacting portion 10 is Hv 250 or less. Since the hardness of the nipple 24 needs to be Hv 120 or more so as to prevent the nipple 24 from collapsing from the caulking, the nipple and the main body are manufactured separately.

SUMMARY OF THE INVENTION

The present invention was developed in order to solve the aforementioned drawbacks, and an object thereof is to provide a method of manufacturing a blank raw material for a hose end fitting and a method of manufacturing a hose end fitting in which continuous production can be made and the manufacturing process is shortened.

In order to achieve the above-described object, a first aspect of the present invention is a method of manufacturing a blank raw material for a hose end fitting, comprising the steps of:

forming a cylindrical pipe-shaped socket portion surrounding a nipple forming portion by inserting a cylindrical pipe-shaped punch into the center portion of a cylindrical rod-shaped material in a state where the external periphery of one end portion of the cylindrical rod-shaped material is held by a cylindrical pipe-shaped metal mold and extrusion molding the end of the cylindrical rod-shaped material thereby creating a cylindrical rod-shaped nipple forming portion for forming a nipple in the center portion of the end of the cylindrical rod-shaped material;

forming a flange portion having a diameter larger than that of the socket portion in the intermediate portion of the cylindrical rod-shaped material in a state where the external periphery of the other end portion of the cylindrical rod-shaped material is held by a cylindrical pipe-shaped metal mold, and forming a cylindrical pipe-shaped connecting portion by inserting a punch in the other end portion of the cylindrical rod-shaped material and extrusion molding the other end portion;

and forming a nipple having a through-hole extending to the bottom surface of the connecting portion in the center portion of the nipple forming portion by inserting a punch in the center portion of the nipple forming portion and extrusion molding the nipple forming portion in a state where the external periphery of the nipple forming portion is held by a cylindrical pipe-shaped punch.

A second aspect of the present invention is a method of manufacturing a blank raw material for a hose end fitting, comprising the steps of:

forming a cylindrical pipe-shaped socket portion surrounding a nipple forming portion by inserting a cylindrical pipe-shaped punch into the center portion of a cylindrical rod-shaped material in a state where the external periphery of one end portion of the cylindrical rod-shaped material is held by a cylindrical pipe-shaped metal mold and extrusion molding the end of the cylindrical rod-shaped material thereby creating a cylindrical rod-shaped nipple forming portion for forming a nipple in the center portion of the end of the cylindrical rod-shaped material;

forming a flange portion having a diameter larger than that of the socket portion in the intermediate portion of the cylindrical rod-shaped material in a state where the external periphery of the other end portion of the cylindrical rod-shaped material is held by a cylindrical pipe-shaped metal mold, and forming a cylindrical pipe-shaped connecting portion by inserting a punch in the other end portion, of the cylindrical rod-shaped material and extrusion molding the other end portion;

forming a hole whose diameter increases the closer to the opening in the connecting portion by inserting a punch in the central portion of the bottom surface of the connecting portion;

forming a seat portion which is connected to a flared tube by deforming the peripheral portion of the hole in the direction of the center of the hole; and forming a nipple having a through-hole extending to the center of the seat portion in the center portion of the nipple forming portion by inserting a punch in the center portion of the nipple forming portion and extrusion molding the nipple forming portion in a state where the external periphery of the nipple forming portion is held by a cylindrical pipe-shaped punch.

In the method of manufacturing a blank raw material for a hose end fitting according to the first aspect, due to insertion of the cylindrical pipe-shaped punch into the central portion of the cylindrical rod-shaped material and extrusion molding one end portion of the cylindrical rod-shaped material in a state in which the outer periphery of one end portion of the cylindrical rod-shaped material is held by a cylindrical pipe-shaped mold, the cylindrical rod-shaped nipple forming portion for forming a nipple is created in the central portion of the end portion of the cylindrical rod-shaped material and the cylindrical pipe-shaped socket portion which surrounds the nipple forming portion is formed. Accordingly, work-hardening takes place on a material which forms the socket portion due to the flow of the material. Flow of the material hardly occurs at all at the central portion of the nipple forming portion which forms a through-hole. Thus, there is little work-hardening and a through-hole can be formed in a later step.

Subsequently, in a state in which the outer periphery of the other end portion of the cylindrical rod-shaped material is held by the cylindrical pipe-shaped mold, the flange portion whose diameter is larger than the diameter of the socket portion is formed at the intermediate portion of the cylindrical rod-shaped material, and the cylindrical pipe-shaped connecting portion is formed at the other end portion of the cylindrical rod-shaped material.

Then, by inserting the punch into the central portion of the connecting portion in a state in which the connecting portion is held in the cylindrical pipe-shaped mold, a cylindrical pipe-shaped connecting portion having a bottom is formed. Moreover, by inserting the punch into and by extrusion molding the central portion of the nipple forming portion in a state in which the outer periphery of the nipple forming portion is held in the cylindrical pipe-shaped punch, a nipple having a through-hole extending to the bottom surface of the connecting portion, is formed at the central portion of the nipple forming portion. In this way, a blank raw material for a hose end fitting is manufactured.

Further, in the method of manufacturing a blank raw material for a hose end fitting according to the second aspect, the nipple forming portion, the socket portion, and the flange portion are formed using the same procedure as that of the method of manufacturing a blank raw material for a hose end fitting according to the first aspect, and thereafter, a hole whose diameter increases moving in the direction of the opening in the connecting portion is formed on the bottom surface of the connecting portion, the peripheral portion of the hole is deformed in the central direction thereof, and a seat portion which is connected to a flared tube is formed. In the present invention, as the pre-molding for forming the seat portion, the hole whose diameter increases moving in the direction of the opening of the connecting portion is formed on the bottom surface of the connecting portion. Consequently, manufacturing resistance at the time of forming the seat portion can be reduced.

If a punch, whose distal end cross-sectional configuration is wedge-shaped, is used at the time of forming the seat portion, force is applied to the seat portion forming portion toward the central direction of the hole due to the inclined surface of the wedge. Thus, manufacturing thereof becomes even easier Then, by inserting the punch into and by extrusion molding the central portion of the nipple forming portion in a state in which the outer periphery of the nipple forming portion is held by the cylindrical pipe-shaped punch, a nipple having a through-hole extending to the bottom surface of the connecting portion is formed in the central portion of the nipple forming portion. In this way, a blank raw material for a hose end fitting is manufactured.

Further, a third aspect of the present invention is a method of manufacturing a hose end fitting in which a hose end fitting is manufactured by threading the connecting portion of the blank raw material for a hose end fitting, which has been manufactured as described above, and by molding the connecting portion into a predetermined configuration for attaching the metal fitting to its companion part.

In the blank raw material for a hose end fitting which has been manufactured in accordance with the method described in the first aspect, a thread is cut in the outer peripheral portion of the connecting portion. In the blank raw material for a hose end fitting which has been manufactured in accordance with the method described in the second aspect, a thread is cut in the inner peripheral portion of the connecting portion. The two connecting portions are thereby connected to each other.

As described above, because the nipple and the main body of the hose end fitting are formed integrally so as to manufacture the blank raw material for a hose end fitting or to manufacture the hose end fitting, the present invention achieves a superior effect in that continuous production can be made and the manufacturing process can be shortened. Further, because air tightness between the nipple and the main body is held at 100%, a superior effect is achieved in that the reliability of the hose end fitting can be greatly improved.

DESCRIPTION OF THE PREFERRED EMBODIMENTS

Figure 1A:
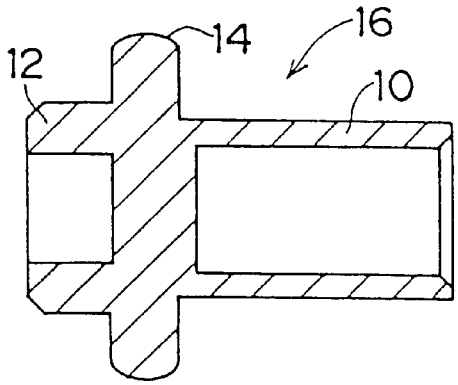
FIG. 1A PRIOR ART
FIGS. 1A through 1D are cross-sectional views which show the procedure of a conventional method of manufacturing a hose end fitting.
Figure 1B:
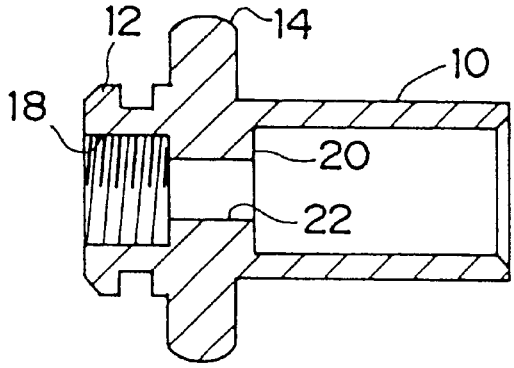
FIG. 1B PRIOR ART
Figure 1C:
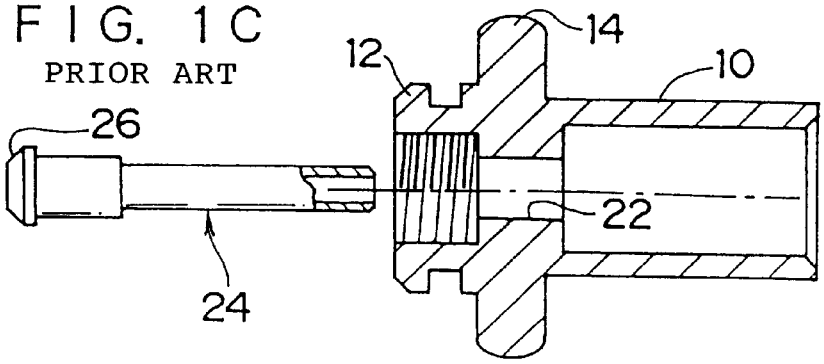
FIG. 1C PRIOR ART
Figure 1D:
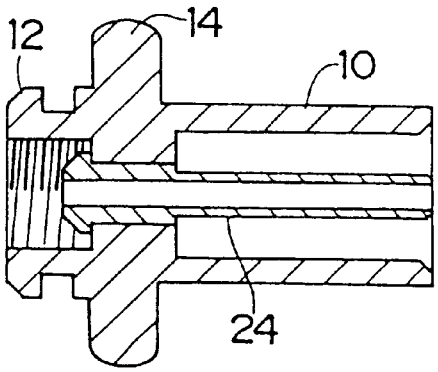
FIG. 1D PRIOR ART
Figure 2A:
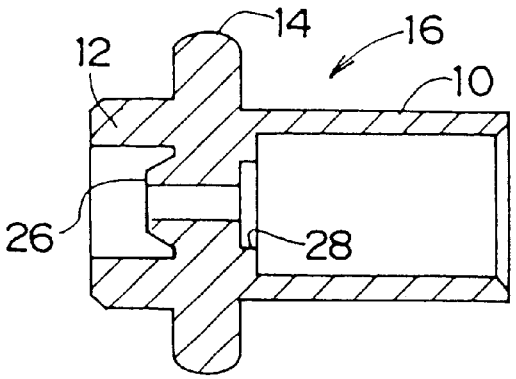
FIG. 2A PRIOR ART
FIGS. 2A through 2D are cross-sectional views which show the procedure of another conditional method of manufacturing a hose end fitting.
Figure 2B:
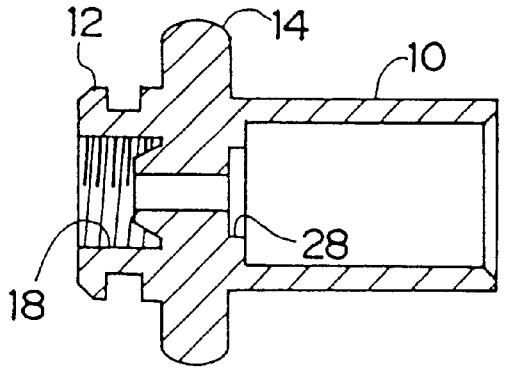
FIG. 2B PRIOR ART
Figure 2C:
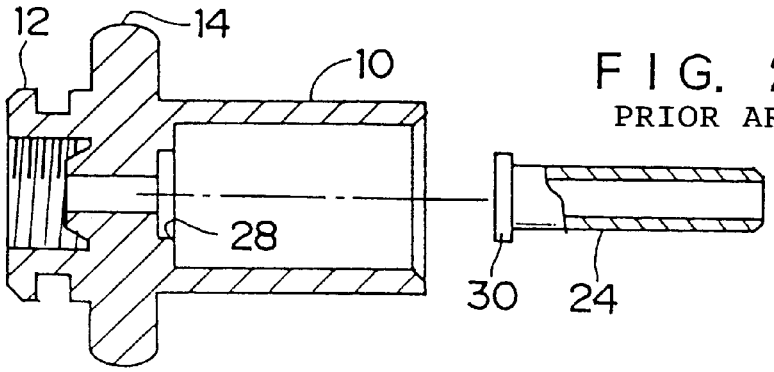
FIG. 2C PRIOR ART
Figure 2D:
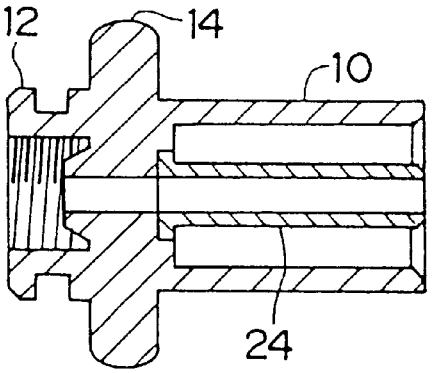
FIG. 2D PRIOR ART
Figure 3:
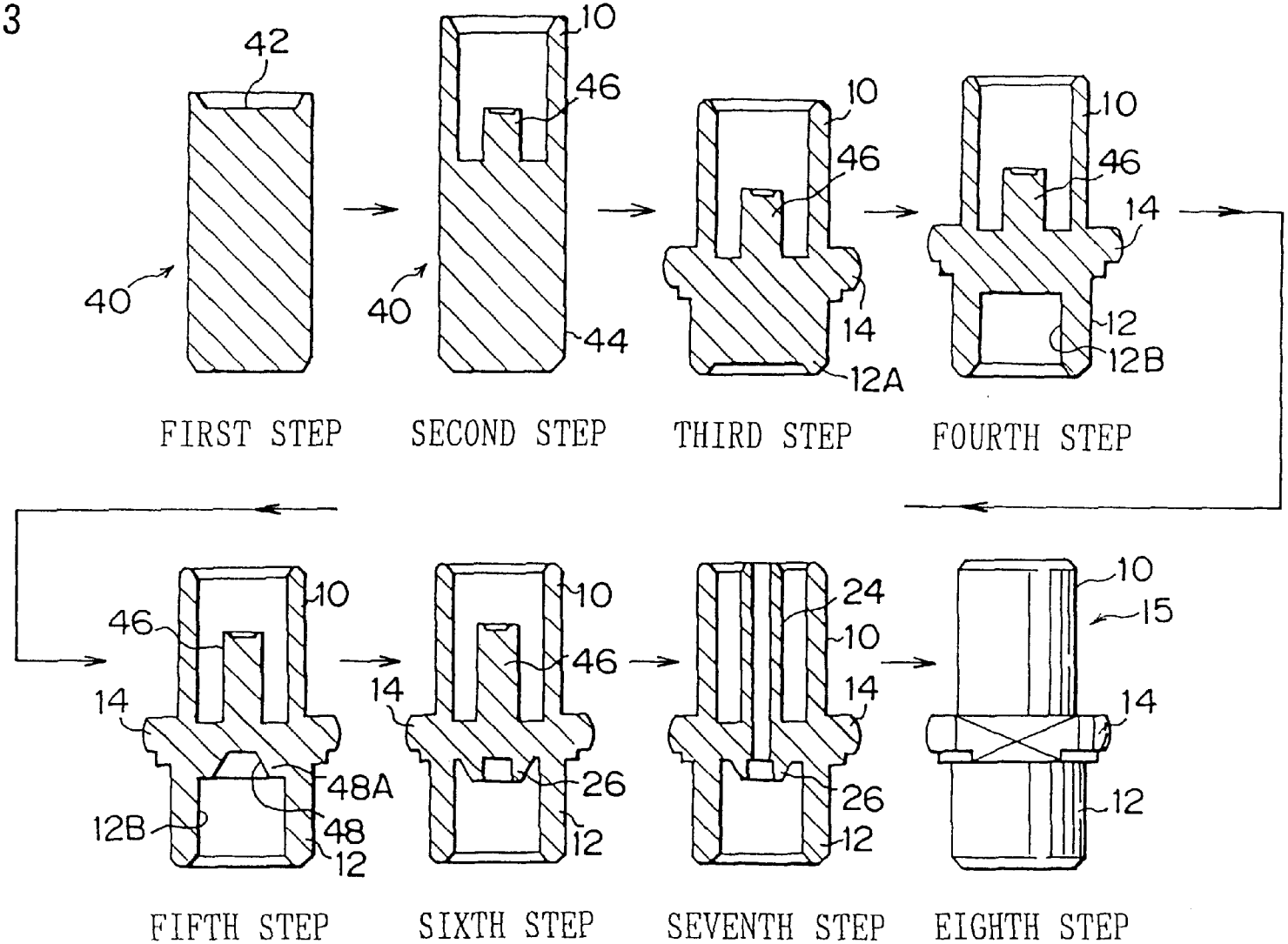
FIG. 3 is a cross-sectional view which shows the procedure of a method of manufacturing a hose end fitting of the present embodiment.
Figure 9:
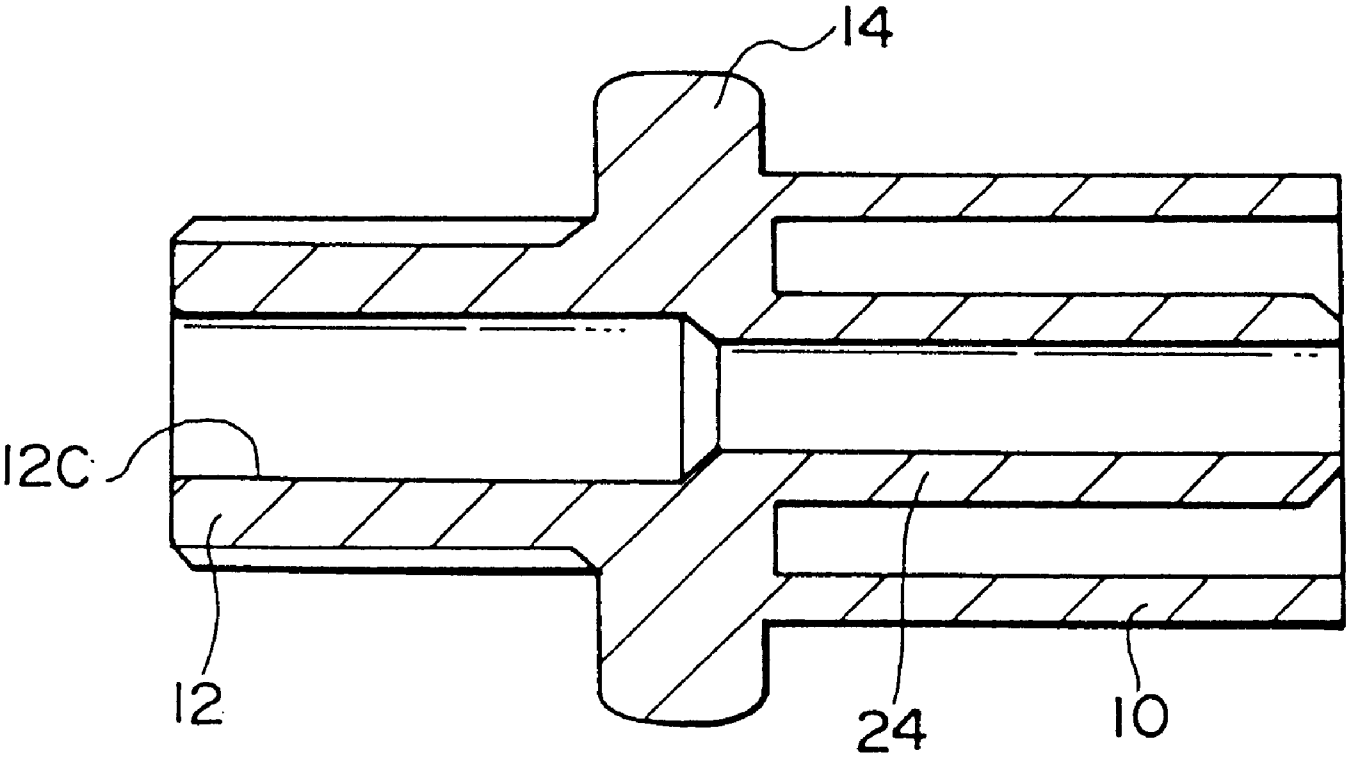
FIG. 9 is a cross-sectional view which shows a hose end fitting of another embodiment.
Figure 10:
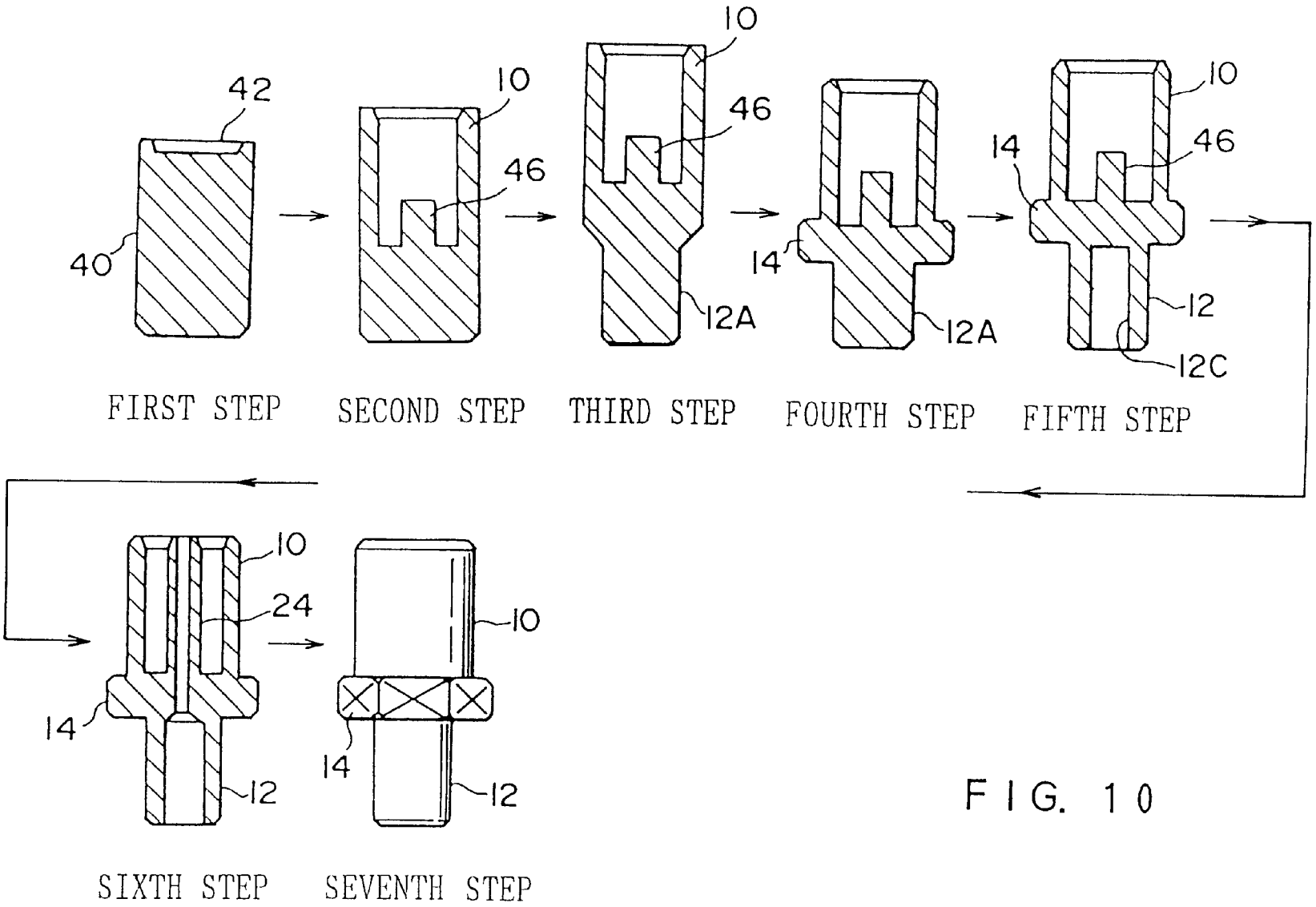
FIG. 10 is a cross-sectional view which shows the procedure of a method of manufacturing the hose end fitting of the other embodiment.

An embodiment of the present invention will be described in detail hereinafter with reference to the drawings. FIG. 3 shows changes in the configuration of a blank from the first through eighth steps of the present embodiment. FIGS. 4A through 6B show the relationship between a mold and the changes in configuration of a blank from the first through eighth steps of the present embodiment. FIG. 9 shows another embodiment. FIG. 10 shows the changes in configurations of a blank from the first through seventh steps of the other embodiment. In FIGS. 4A through 6B, the molds used in the steps are assembled for the convenience of explanation.

In the present embodiment, it is preferable that a material having HRB (B scale of a Rockwell hardness tester) 70 or less is used as the material of manufacturing a blank raw material for a hose end fitting.

① First Step

In the first step, a stamping process is effected in which an end surface 42 of a material piece 40, which has been cut out from a wire rod, is reformed. In this way, centering of the material piece is effected and planarity of the end surface is guaranteed.

② Second Step

Figure 4A:
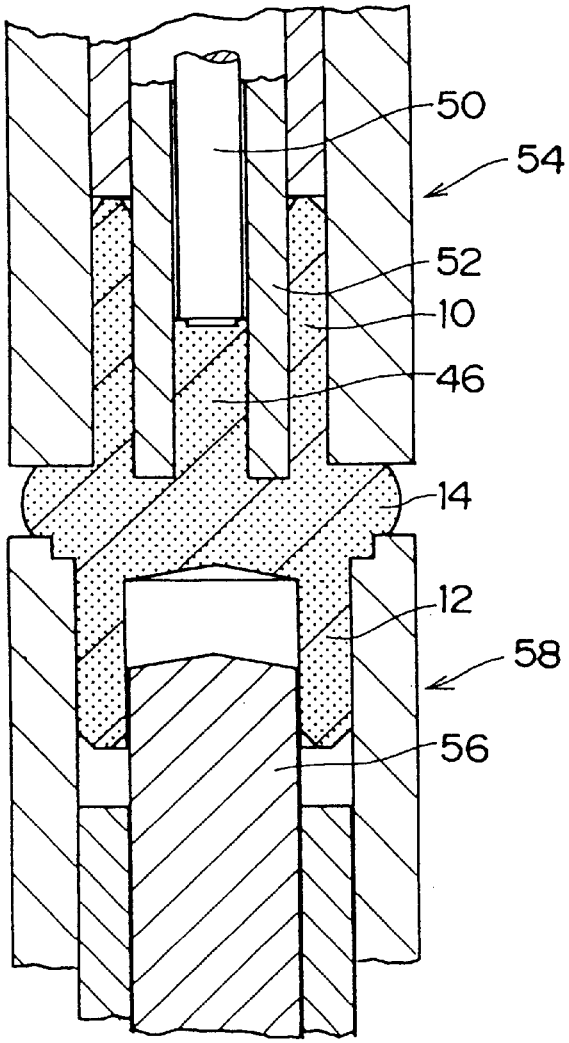
FIGS. 4A and 4B are cross-sectional views which show the relationship between a mold and the procedure of the method of manufacturing a hose end fitting of the present embodiment.

One end 44 of the material piece 40 is fixed. As shown in FIG. 4A, another end of the material piece 40 is subjected to cold forming by using a mold 54, which includes a cylindrical pipe-shaped punch 52 having a stopper pin 50 inside it. Accordingly, a cylindrical rod-shaped nipple forming portion 46, which forms a portion of a nipple, and a cylindrical pipe-shaped socket portion 10 having a bottom, which serves as a hose press-contacting portion, are formed.

In this second step, since the socket portion 10 is formed due to rearward extrusion, work-hardening takes place in the material which forms the socket portion 10 due to the flow of the material. The hardness of the socket portion 10 at this time is about Hv 250 (Vickers hardness tester) or less.

On the other hand, because the socket portion 10 is formed due to the rearward extrusion, the flow of the material occurs in the surface layer portion of the nipple forming portion 46. However, hardly any flow of the material occurs inside the nipple forming portion 46. As a result, work-hardening takes place in the surface layer portion of the nipple forming portion 46, but there is little work-hardening inside the nipple forming portion 46. The nipple forming portion 46 is of a hardness sufficient to allow a through-hole to be punched therein in a later step.

③ Third Step

The socket portion 10 side is fixed. As shown in FIG. 4A, the end portion of the material at the side opposite the socket portion 10 is subjected to cold forming by a mold 58 having a punch 56. At the intermediate portion of the material, a flange portion 14 which has a diameter larger than that of the socket portion 10 is formed and a head portion 12A of a screw connecting portion 12 which serves as a connecting portion is molded.

④ Fourth Step

The socket portion 10 side is fixed. As shown in FIG. 4A, a hole 12B which serves as a tap drill hole is formed by using the mold 58 having the punch 56. A cylindrical pipe-shaped screw connecting portion 12 having a bottom is thereby formed.

⑤ Fifth Step

Figure 4B:
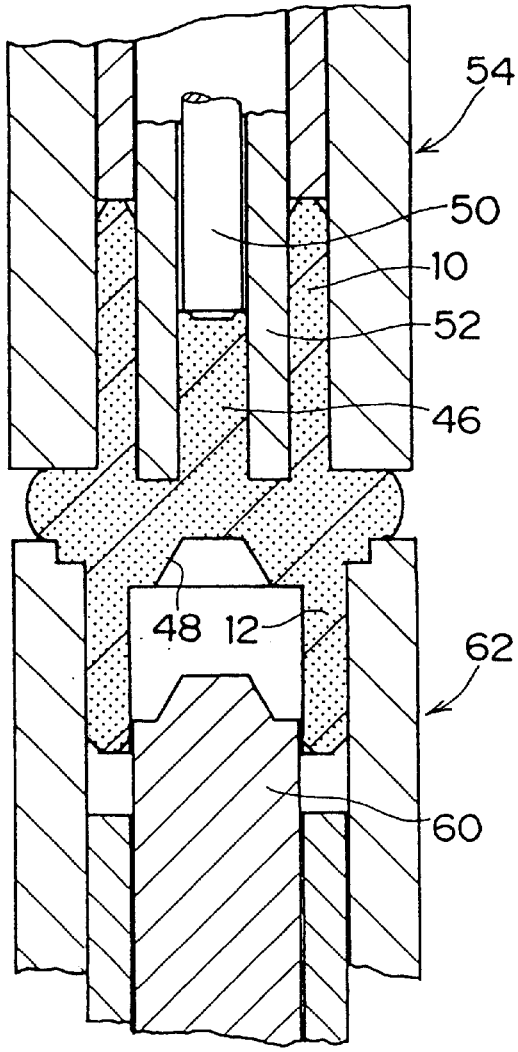

The socket portion 10 side is fixed. As shown in FIG. 4B, a truncated cone-shaped hole 48 is formed on the bottom surface of the screw connecting portion 12 by using a mold 62 having a punch 60 whose distal end configuration is truncated cone-shaped. Accordingly, pre-molding for forming a seat portion 26 takes place. In this pre-molding, the outer periphery of the nipple forming portion 46 is held by the cylindrical pipe-shaped punch 52. As a result, due to the flow of the material at the time of forming the truncated cone-shaped hole 48 in this pre-molding, the nipple forming portion 46 extends by a volume which is the same as that of the truncated cone-shaped hole 48.

The load applied to the punch 60 can be reduced and the life of the punch 60 can be made longer due to this type of flow occurring in the material.

⑥ Sixth Step

Figure 5A:
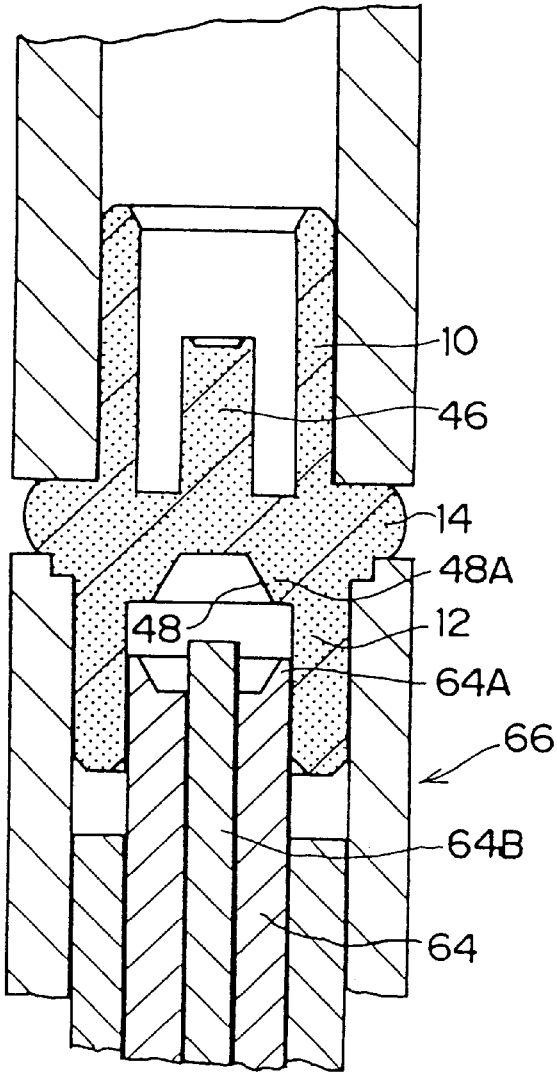
FIGS. 5A and 5B are cross-sectional views which show the relationship between a mold and the procedure of the method of manufacturing a hose end fitting of the present embodiment.
Figure 5B:
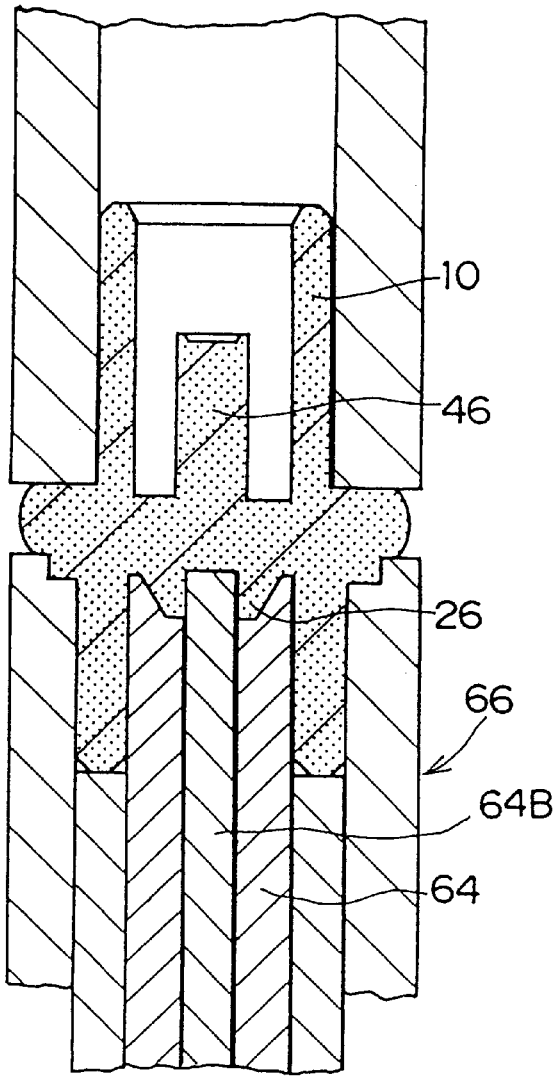

The socket 10 side is fixed. As shown in FIG. 5A, a punch 64 includes a stopper pin 64B and the distal end cross-sectional configuration of the punch 64 is wedge-shaped due to the formation of a truncated cone-shaped cavity at a distal end portion 64A. Using the punch 64, the distal end portion 64A of the punch 64 is moved so as to be inserted into a borderline portion between the inner wall of the screw connecting portion 12 and the peripheral portion 48A of the truncated cone-shaped hole 48. The material which forms the peripheral portion 48A of the truncated cone-shaped hole 48 is deformed in the direction of the truncated cone-shaped hole 48. In this way, a seat portion 26 which includes a portion whose cross-sectional configuration is substantially wedge-shaped is formed between the outer circumferential surface of the stopper pin 64B and the inner circumferential surface of the distal end portion of the punch 64.

Because the truncated cone-shaped hole 48 is formed in the fifth step, when the peripheral portion 48A of the truncated cone-shaped hole 48 is deformed in the direction of the truncated cone-shaped hole 48 in the sixth step, large transverse and compressive loads are not applied to the punch 64. Consequently, the transverse and compressive loads applied to the distal end portion 64A of the punch 64 can be minimized. As a result, the damage to the distal end portion 64A of the punch 64 can be prevented.

⑦ Seventh Step

Figure 6A:
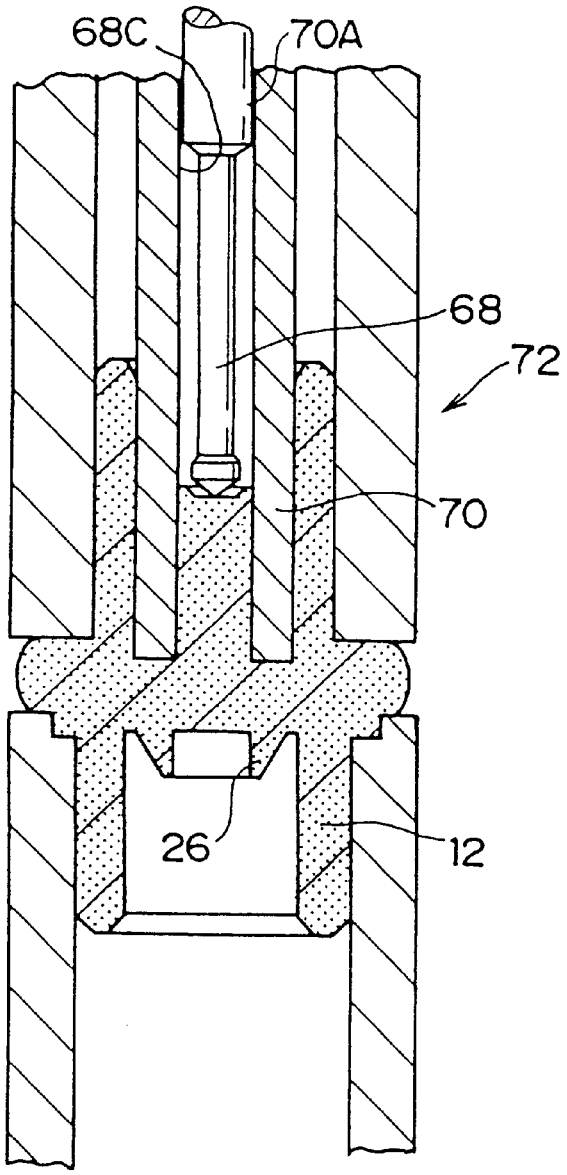
FIGS. 6A and 6B are cross-sectional views which show the relationship between a mold and the method of manufacturing a hose end fitting of the present embodiment.

The screw connecting portion 12 is fixed. As shown in FIG. 6A, using a mold 72 which includes a cylindrical pipe-shaped punch 70 having a punch 68, the punch 68 is inserted into the center of the nipple forming portion 46 while the outer periphery of the nipple forming portion 46 is held by the punch 70 thus forming the nipple 24 by rearward extrusion.

Figure 7:
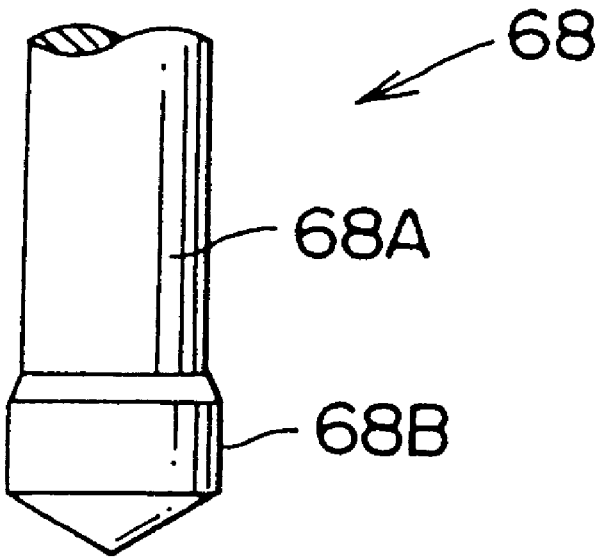
FIG. 7 shows the configuration of the distal end portion of a punch which forms a through-hole at a nipple forming portion.

Since the outer periphery of the nipple forming portion 46 is held by the punch 70, transverse bending of the nipple forming portion 46 at the time of punching is prevented and the transverse load applied to the punch 68 can be reduced. Further, as shown in FIG. 7, in order to reduce the punching resistance of the punch 68, the diameter of the intermediate portion 68A of the punch 68 is set smaller than the diameter of the distal end portion 68B thereof such that a clearance of 5/100 mm or less is generated between the inner periphery 70A of the punch 70 and the outer periphery 68C of the punch 68. Accordingly, the transverse load can be also minimized by the structure of the punch 68 itself.

Because the nipple forming portion 46 in the fifth step is slightly longer than the nipple forming portion 46 formed in the second step while the configuration thereof remains the same, the hardness of the nipple forming portion 46 does not increase more than the hardness thereof at the time of work-hardening in the second step and rearward extrusion can be easily effected. Moreover, in this rearward extrusion, the volume of the extruded and elongated portion of the nipple forming portion 46 is substantially the same as that of the punch 68 inserted at the time of forming the through-hole.

After the nipple 24 is formed, a portion 71 which remains at the seat portion 26 side of the inner portion of the nipple 24 (FIG. 6B) is removed by a pin and discharged as residue to form a through-hole.

Since the mold is structured as described above, application of the transverse load to the punch is prevented and manufacturing resistance can be reduced. Unnecessary load other than the load for forming a through hole (the load for punching) cannot be generated and the life of the punch can be increased greatly.

The blank raw material for a hose end fitting is manufactured in the above first through seventh steps. The Vickers hardness of the main body of the blank raw material for a hose end fitting is about Hv 250 or less and the Vickers hardness of the nipple is about Hv 120 or more.

⑧ Eighth Step

In the eighth step, a trimming process, which molds the flange portion 14 into the configuration for attaching a end fitting, is carried out so as to manufacture a blank raw material 15 for a hose end fitting which corresponds to the attaching configuration of its companion part. In a subsequent step, a thread is tapped to form a female screw in the inner periphery of the screw connecting portion 12 using a tap, and as occasion demands, a groove whose cross-sectional surface is rectangular is formed at the outer periphery of the screw connecting portion 12. A hose end fitting is thereby manufactured.

The above-described blank raw material for a hose end fitting and the hose end fitting are provided for manufacturers.

In the above-described first through eighth steps, the stamping process, which reforms the end surface of the material piece cut out from the wire rod, may be omitted from the first step. Moreover, the fourth step may be omitted and manufacturing can be effected directly from the third step to the fifth step. Accordingly, the number of man-hours can be reduced.

Figure 8:
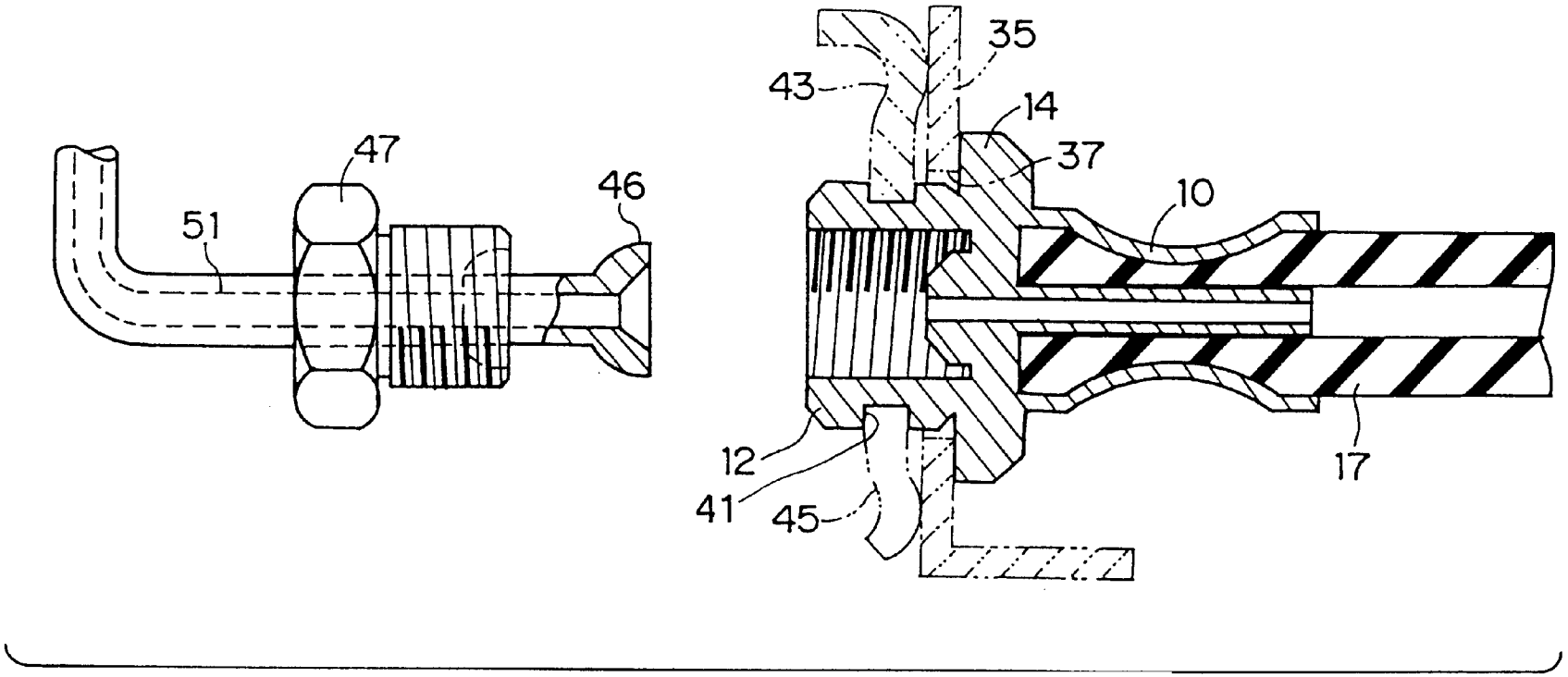
FIG. 8 is a cross-sectional view which shows a state in which the hose end fitting of the present embodiment is mounted.

As shown in FIG. 8, the end fitting manufactured as described above is fixed by caulking to the end portions of a rubber hose 17 and is formed as the assembly of a brake rubber hose for an automobile. Moreover, the screw connecting portion 12 is inserted through a through-hole 37 of a bracket 35 which is adhered to a vehicle body (unillustrated). The peripheral edge portion of a notch portion 45 of a clip 43 is inserted into a groove 41 whose cross-sectional configuration is rectangular and which is formed at the outer periphery of the screw connecting portion 12. The bracket 35 is nipped and engaged between the inserted clip 43 and the flange portion 14. The end fitting is thereby attached to the vehicle body. In FIG. 8, a flared portion 49, a flared nut 47, and a tube 51 are shown.

Description is given hereinbefore of the method of manufacturing a blank raw material for a hose end fitting which is connected to the flared tube and the method of manufacturing a hose end fitting. However, the present invention is not limited to this. As shown in FIG. 9, a hose end fitting without having a seat portion and a blank raw material for a hose end fitting for manufacturing this hose end fitting can be manufactured.

In this case, first, in accordance with the procedures of the first through fifth steps (the step corresponding to the second step in FIG. 3 can be omitted), a socket portion 10, a nipple forming portion 46, a flange portion 14, and a head portion (connecting portion) 12A of a screw connecting portion 12 are formed, a cylindrical pipe-shaped hole 12C having a bottom is formed in the head portion 12A of the screw connecting portion 12, and the cylindrical pipe-shaped screw connecting portion 12 is formed. The diameter of the head portion 12A is formed smaller than that of the socket portion 10. Further, when the hose end fitting is completely manufactured, the hole 12C serves as a passage for the fluid. Accordingly, the inner diameter of the hole 12C is formed smaller than the outer diameter of the above-described head portion 12A which serves as a diameter before thread-rolling.

Figure 6B:
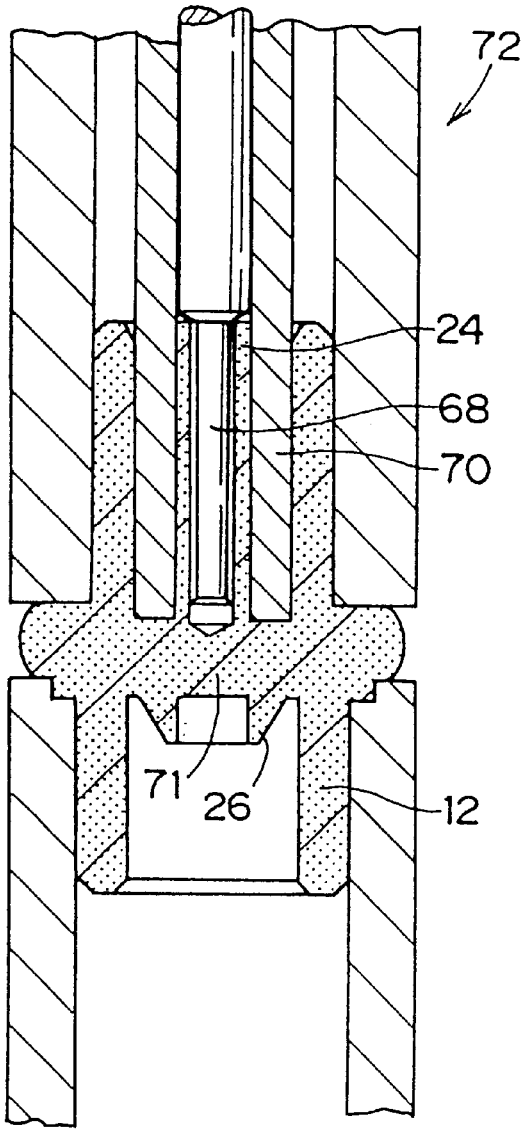

Thereafter, in accordance with the sixth step (the step which is the same as the seventh step in FIG. 3), as shown in FIGS. 6A and 6B, the punch 68 is inserted into the center of the nipple forming portion 46 while the outer periphery of the nipple forming portion 46 is held by the punch 70 and the nipple 24 is formed by rearward extrusion. Then, a thread is cut on the outer periphery of the screw connecting portion 12 using a punch in the subsequent step and a hose end fitting is thereby manufactured.

What is claimed:

1. A method of manufacturing a blank raw material for a hose end fitting, comprising the steps of:

providing a rod-shaped material having a socket end and a screw-connecting end;

forming at the socket end of the rod-shaped material a pipe-shaped socket portion and a rod-shaped nipple portion surrounded by the pipe-shaped socket portion, by (i) fitting an external periphery of the rod-shaped material to a first pipe-shaped mold; and (ii) inserting a first pipe-shaped punch into a center portion of the rod-shaped material supported by the first pipe-shaped mold to form by extrusion-molding (i) the rod-shaped nipple portion inside the first pipe-shaped punch and (ii) the pipe-shaped socket portion between the first pipe-shaped punch and the first pipe-shaped mold;

forming a flange portion having a diameter larger than that of said socket portion in an intermediate portion of said rod-shaped material by fitting second pipe-shaped mold to the screw-connecting end so as to sandwich and compress the intermediate portion between the first pipe-shaped mold and the second pipe-shaped mold, forming a screw-connecting portion at the screw-connecting end by inserting a punch in a center portion of said rod-shaped material when an external periphery of the rod-shaped material is supported by the second pipe-shaped mold; and forming a rod-shaped nipple having a through-hole extending to a bottom surface of the screw-connecting portion by (i) fitting a pipe-shaped punch between the pipe-shaped socket portion and the rod-shaped nipple portion to support an external periphery of the rod-shaped nipple portion;

(ii) inserting a rod-shaped punch in the center portion of said rod-shaped nipple portion while the rod-shaped nipple portion is statically supported by the pipe-shaped punch (iii) forming by extrusion-molding a nipple with a cavity between the pipe-shaped punch; and the rod-shaped punch, and (iv) extending the rod-shaped punch to the bottom surface of the screw-connecting portion to form the through-hole.

2. A method of manufacturing a blank raw material for a hose end fitting according to claim 1, wherein the step of providing a rod-shaped material comprises reforming an end surface of a piece of material which has been cut from a wire rod.

3. A method of manufacturing a blank raw material for a hose end fitting according to claim 1, wherein the pipe-shaped punch in the step of forming the socket portion has inside a stopper pin to form a top surface of the rod-shaped nipple-forming portion.

4. A method of manufacturing a blank raw material for a hose end fitting according to claim 1, wherein said socket portion has a Vickers hardness of approximately Hv 250 or less.

5. A method of manufacturing a blank raw material for a hose end fitting according to claim 1, wherein in the step of forming said nipple, the rod-shaped punch has a distal end portion having a diameter greater than that of an intermediate portion thereof.

6. A method of manufacturing a blank raw material for a hose end fitting according to claim 1, wherein said socket portion has a Vickers hardness of approximately Hv 120 or more.

7. A method of manufacturing a blank raw material for a hose end fitting according to claim 5, wherein there is a clearance of 5/100 mm or less between the pipe-shaped punch and the rod-shaped punch.

8. A method of manufacturing a blank raw material for a hose end fitting according to claim 1, wherein the rod-shaped nipple portion is extended between the pipe-shaped punch and the rod-shaped punch by rearward extrusion.

9. A method of manufacturing a blank raw material for a hose end fitting according to claim 1, wherein the screw-connecting portion, has a truncated cone-shape and a concave bottom.

10. A method of manufacturing a blank raw material for a hose end fitting according to claim 9, wherein the step of forming the screw-connecting portion further comprises deforming the concave bottom to form a convex shape having a cavity in its center.

* * * * *